US006675496B1

(12) United States Patent
Moon et al.

(10) Patent No.: US 6,675,496 B1
(45) Date of Patent: Jan. 13, 2004

(54) DRYER DRUM BEARING ASSEMBLY

(75) Inventors: Joseph Moon, Greer, SC (US); John J. Burns, Simpsonville, SC (US); Jerry W. Owens, Jr., Boiling Springs, SC (US)

(73) Assignee: The Felters Company, Roebuck, SC (US)

( * ) Notice: Subject to any disclaimer, the term of this patent is extended or adjusted under 35 U.S.C. 154(b) by 0 days.

(21) Appl. No.: 10/210,295

(22) Filed: Aug. 1, 2002

(51) Int. Cl.[7] ..... F26B 11/02

(52) U.S. Cl. ..... 34/601; 34/242; 34/598; 384/298; 384/911

(58) Field of Search ..... 34/598, 601, 602, 34/603, 242, 239; 384/298, 909, 911

(56) References Cited

U.S. PATENT DOCUMENTS 3,828,445 A * 8/1974 Smoot ..... 34/242
4,669,200 A * 6/1987 Carr ..... 34/242
5,216,823 A 6/1993 Ripley ..... 34/133
5,288,354 A * 2/1994 Harris et al. ..... 156/154
5,363,569 A 11/1994 Kadakia ..... 34/601
5,548,908 A * 8/1996 Torborg et al. ..... 34/601
6,398,415 B1 * 6/2002 Ibe et al. ..... 384/214

* cited by examiner

*Primary Examiner*—Ira S. Lazarus
*Assistant Examiner*—Kathryn S. O'Malley
(74) *Attorney, Agent, or Firm*—Robertson & Mullinax, LLC

(57) ABSTRACT

A bearing for supporting the drum of a clothes dryer which includes an interior structural layer of high coherency felted fibrous material and an exterior surface covering for contact with the dryer drum formed of fibrous material including a wool constituent. The felted interior provides support and noise damping character while the exterior surface covering provides friction reduction and enhanced flame retardancy.

13 Claims, 3 Drawing Sheets

DRYER DRUM BEARING ASSEMBLY

FIELD OF THE INVENTION

The present invention relates generally to bearing structures and, more particularly, to a bearing assembly for rotatably mounting and supporting a drum in a clothes dryer

BACKGROUND

Bearing and seal assemblies for use in supporting relation to rotating drums within clothes dryers are generally known. Such assemblies used in the past have included pliable ring structures incorporating materials such as surface pads of felt disposed at selected regions within the ring structure to dampen the vibration and noise associated with the rotation of the dryer drum. One prior assembly incorporating a felt seal with felt of different density disposed at different regions around a split ring bearing with a friction reducing powder coating across an upper wear surface is disclosed in U.S. Pat. No. 5,363,569 to Kadakia, the teachings of which are incorporated by reference herein. Another prior assembly is disclosed in U.S. Pat. No. 5,216,823 to Ripley the teachings of which are incorporated by reference herein in which the bearing is comprised of a ring of felt-like material having an upper portion of relatively dense felt and a lower portion of relatively less dense felt. The upper portion includes wear-resistant pads which bear the weight of the drum.

While bearing assemblies of the prior types may provide rotational support for the front end of the dryer drum, the use of wear resistant coatings or surface pads may add complexity to the manufacturing process. Moreover, such assemblies may be prone to premature loss of friction resistance if a pad becomes displaced or if a section of the friction reducing coating is preferentially worn away. Since clothes dryers are typically used for a number of years, such premature degradation is generally undesirable.

SUMMARY OF THE INVENTION

The present invention provides advantages and alternatives over the prior art by providing a bearing for supporting the drum of a clothes dryer which includes an interior structural layer of high coherency felted fibrous material and an exterior surface covering for contact with the dryer drum formed of fibrous material including a wool constituent. The felted interior provides support and noise damping character while the exterior surface covering provides friction reduction and enhanced flame retardancy.

BRIEF DESCRIPTION OF THE DRAWINGS

The present invention will now be described by way of example only, with reference to the accompanying drawings which constitute a part of the specification herein and in which.

While the invention will hereinafter be described in connection with exemplary illustrated embodiments, it is to be understood that in no event is the invention to be limited to such illustrated and described embodiments. On the contrary, it is intended that the present invention shall extend to all alternatives and modifications as may embrace the principles of this invention within the broad spirit and scope thereof.

DESCRIPTION OF PREFERRED EMBODIMENTS

Figure 1:
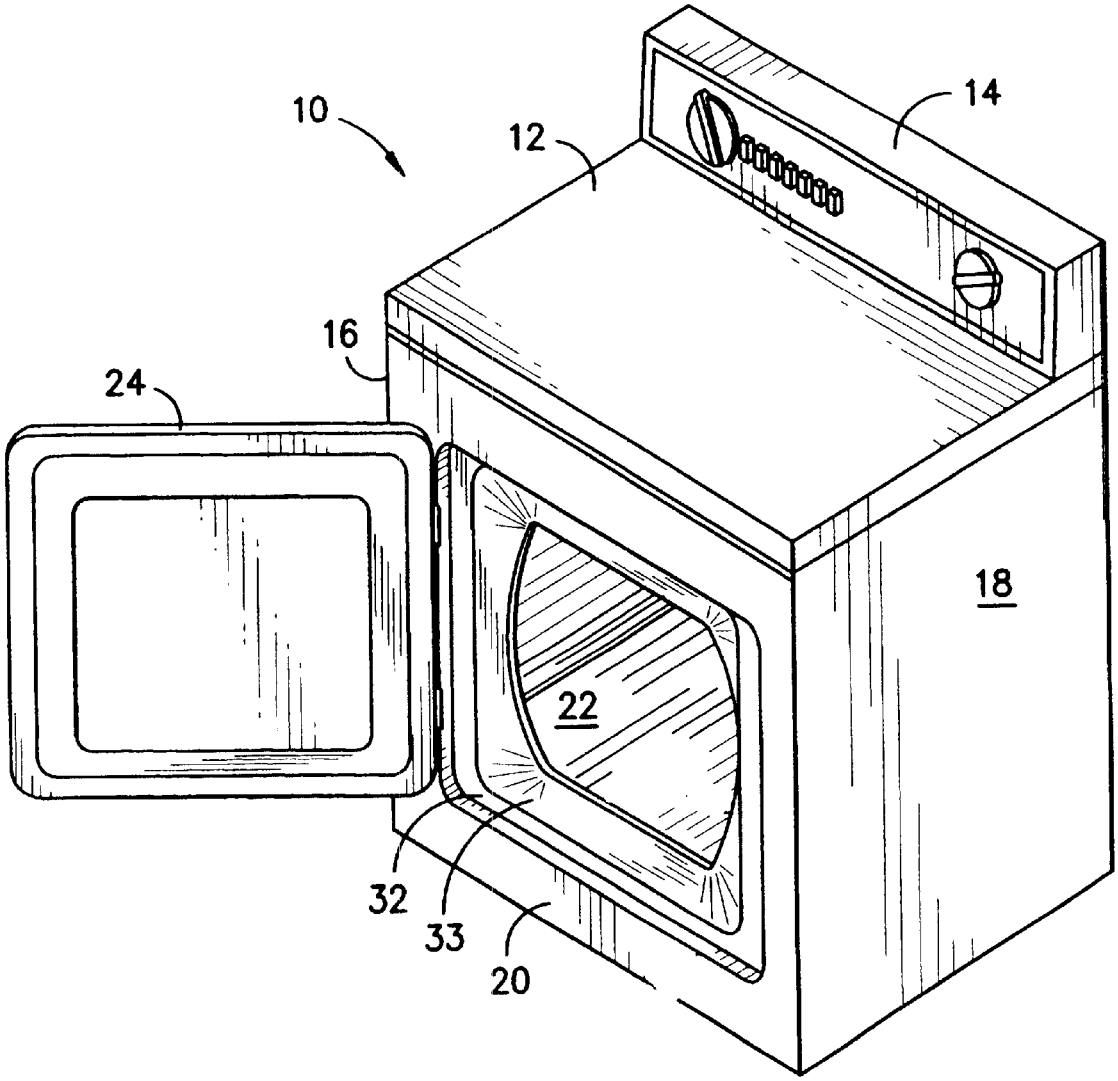
FIG. 1 is a front perspective view of a domestic clothes dryer.

With reference to FIG. 1, a clothes dryer 10 of the domestic type which incorporates a bearing in accordance with the present invention is illustrated. The clothes dryer 10 has a box-like cabinet formed from painted sheet metal, as is well known in the art. The dryer 10 includes a horizontal top panel 12 with a control console 14 extending along its rear edge. The control console allows the user to regulate the operation of the clothes dryer 10 to provide drying of clothes placed within the dryer in a predetermined manner. The dyer 10 further includes a pair of vertical side panels 16 and 18, and a vertical rear panel (not shown).

A vertical front panel 20 provides an access opening 22 which is normally closed by a door 24 that is hinged along its left edge, as shown, for movement about a vertical axis. When the door 24 is open as shown in FIG. 1, a user can reach through the access opening 22 and into the interior of the clothes dryer 10 to insert clothing therein or remove clothing therefrom.

Figure 2:
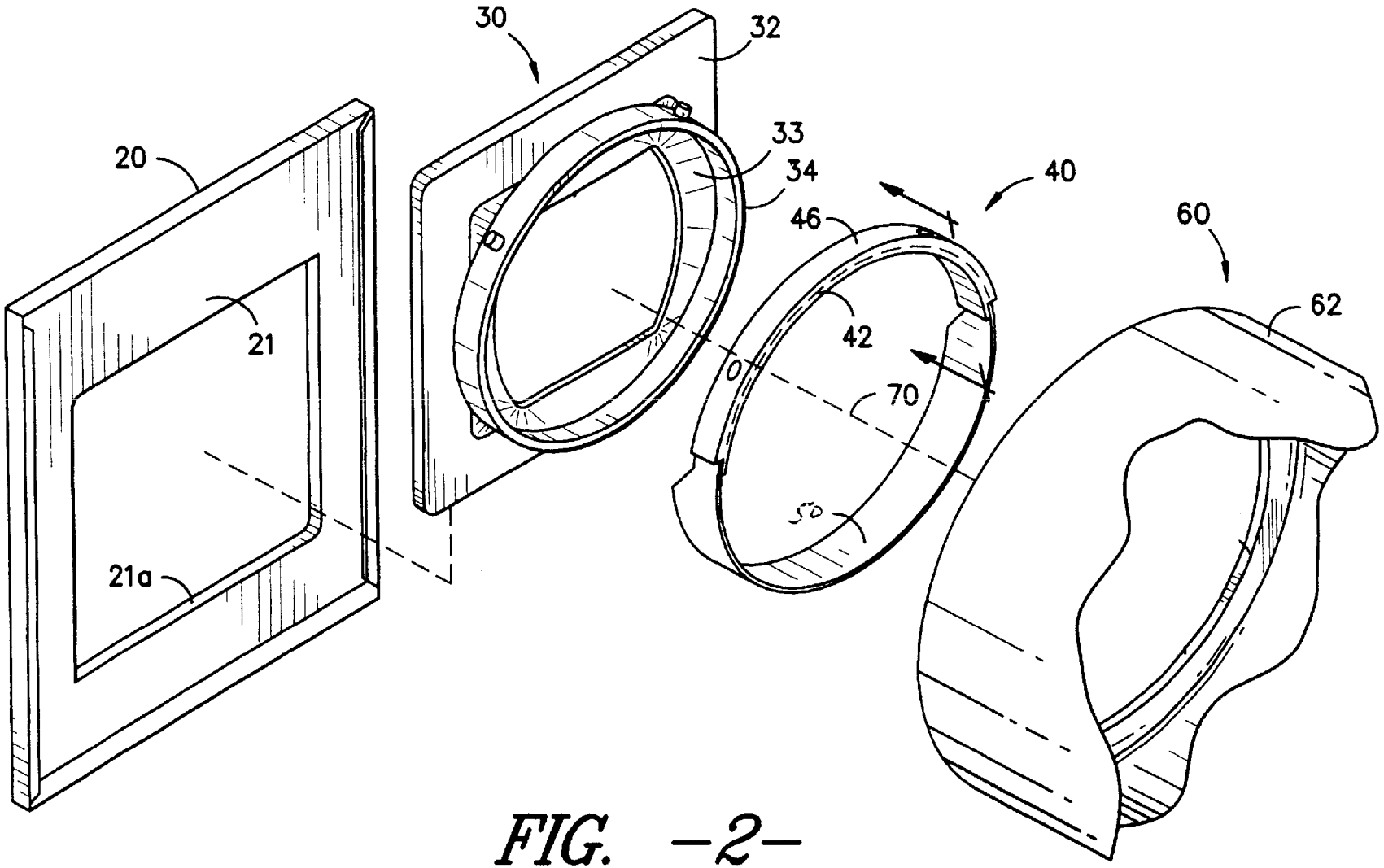
FIG. 2 is an exploded perspective view of the clothes dryer of FIG. 1, illustrating a bearing assembly in accordance with the present invention.

Turning to FIG. 2 of the drawings, the clothes dryer discussed with regard to FIG. 1 can be seen to include, in addition to the front panel 20, a drum support panel 30, a bearing assembly 40 in accordance with the present invention, and a dryer drum 60 that, in operation, rotates on a horizontal axis 70.

The front panel 20 provides an inner surface 21 having an inner periphery 21*a* which defines, in part, the access opening 22 (see FIG. 1). The front panel 20 also provides a seat against which the door 24 seals during operation of the dryer 10. A conventional switch (not shown) is provided adjacent the front panel to preclude operation of the dryer without closure of the door 24 against the front panel 20.

The drum support panel 30 has a generally planar, plate-like front portion 32 that is fixed by suitable mechanical means to the inner surface 21 of the front panel 20. With further reference to FIG. 2, the drum support panel 30 includes, in addition to the plate-like front portion 32, a transition ring 33 that is generally annular in shape.

The transition ring 33 has extending horizontally from its outer circular periphery a circular drum support flange 34 which is inwardly spaced from the plate-like front portion 32. The transition ring 33 extends inwardly from the plate-like portion 32 to support the circular drum support flange 34 at a relatively inwardly displaced position. When assembled, by welding or suitable mechanical fastening means, the front panel 20 and the drum support panel 30 are fixed in position relative to each other and constitute a substantially unitary structure.

The bearing assembly 40, in accordance with the invention, rotatably supports the front end 62 of the dryer drum 60, the rear end (not shown) of the drum 60 being supported by conventional means. The assembly 40 preferably includes an upper load bearing portion 42 of a interior felt material 43 (FIG.3) adjoined in needled relation to a fibrous surface layer 44 defining a low friction bearing surface 46 (FIG. 2.)

Figure 3:
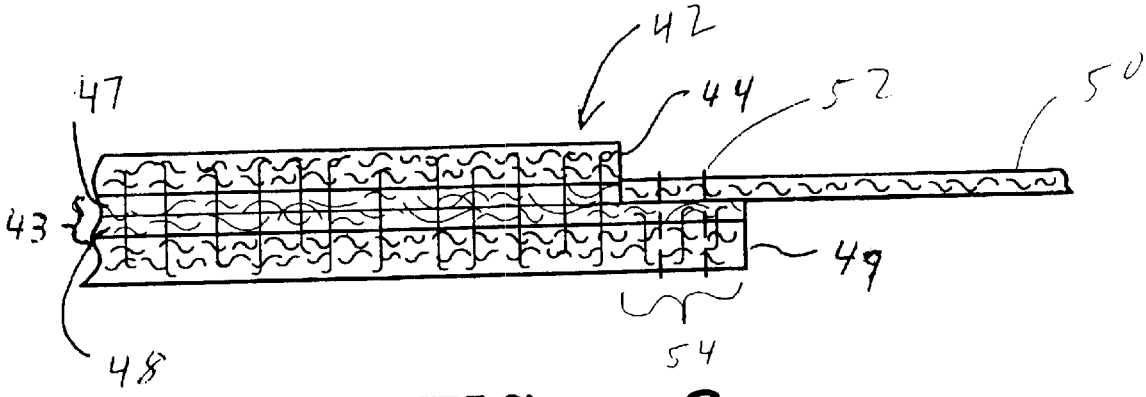
FIG. 3 is a cut-away side view of a section of the bearing assembly of FIG. 2.

The interior felt material 43 is of a density and coherency such that that it distributes applied loads and prevents substantial compacting of the load bearing portion 42 due to the load or weight of the front end 62 of the dryer drum 60. It is contemplated that the interior felt material may be of either a single layer or a multi-layer construction. One exemplary multi-layer construction is illustrated in FIG. 3 wherein the interior felt material 43 is made up of a first layer 47 in substantially adjacent relation to the surface layer 44 with at least a second layer 48 extending away from the first layer 47.

One contemplated method for manufacture of a multi-layer construction is to incorporate a light weight heat activated fabric adhesive between layers of felted batting and to needle adjacent layers of felted batting across the fabric adhesive followed by heat activation of the adhesive to retain the coordinated structure. An exemplary process and resulting multi-layer high density felted materials suitable for use in the present invention is provided in commonly assigned pending U.S. patent application Ser. No. 09/576,720 the contents of which are incorporated herein in their entirety. Of course other production processes may also be utilized if desired.

According to a potentially preferred practice, the interior felt material 43 is formed by needling long-staple synthetic fibers such as polyester or the like. By way of example only other materials may include polypropylene, polyamide, acrylic, aramid fibers. Of course, blends of any of the foregoing may also be used. If desired, a percentage of natural fibers such as wool or the like may also be added. The use of long staple synthetic fibers is particularly preferred to enhance tensile strength and to reduce elongation. According to one potentially preferred practice, the interior felt material 43 may include a percentage of fibers including a low melting point constituent such as low melting point polyester fibers or bicomponent polyester fibers having a core of high melting point polyester and a sheath of low melting point polyester. Such low melting point constituent fibers may be added directly during blending of the fibers making up the interior felt material 43 and are entangled with the other fibers during needling of the interior felt material.

The surface layer 44 which contacts the drum 60 is preferably of a nonwoven construction formed by needling or the like although other fibrous constructions including woven or knitted constructions may likewise be utilized if desired. The material forming the surface layer 44 is preferably wool or a blend of wool and synthetic fibers such as polyester or the like as described above. The use of a wool constituent in the surface layer 44 is believed to substantially reduce friction with the drum 60 while substantially improving flame retardancy. It is also contemplated that other friction reducing materials may be blended with the fibers forming the surface layer or may be applied after formation.

As illustrated, an underlying containment layer 49 may be disposed across the side of the interior felted material 43 facing away from the surface layer 44. However, it is also contemplated that the containment layer 49 may be eliminated if desired. If an underlying containment layer 49 is utilized, the material forming such containment layer is most preferably a wool or wool blend as used in the surface layer 44. However, it is contemplated that virtually any material having adequate flame retardancy character may be utilized.

As shown, the surface layer 44 and the containment layer 49 are preferably needled in juxtaposed relation to the interior felt material 43 to form a substantially coordinated sandwich structure. That is, during the formation process, fibers from the surface layer 44 and the containment layer are carried into and intermingle with the fibers of the high density felt material. If desired, an adhesive layer may be disposed between the surface layer 44 and the interior felt material 43 and/or between the containment layer 49 and the interior felt material to further enhance the attachment.

According to one exemplary manufacturing process, the surface layer 44, the interior felt material 43 and the containment layer 49 are each formed separately to have a substantially equivalent density. One potentially preferred density range is about 432 to about 576 pounds per cubic yard. However, one or more layers may have substantially higher or lower densities if desired. The individual layers are thereafter brought together at a needling station for final needling into a substantially coordinated composite structure. This needling operation may be either a single pass or a multiple pass needling operation. By way of example, if the interior felted material 43 is required to be extremely dense and/or extremely thick, it may be desirable to needle batts of material forming the surface layer 44 and containment layer 49 through opposing sides in separate operations.

Once the layers of the load bearing portion 42 have been combined by needle punching, the resulting structure is preferably subjected to heat and pressure such as in a flat pressing or calendering operation. As will be appreciated, this process activates any low melting point constituents to further enhance coherency by causing the low melting point constituent to flow and thereby form a bonding matrix within the interior layer. This bonding matrix may also promote the ability of the interior layer to carry loads applied during use. In addition, the pressurized heat activation causes the interior layer to compress thereby increasing the overall density and strength of the interior layer 43 such that the density of the interior layer 43 in the resulting product is slightly higher than the density of the other layers. In addition, the application of heat and pressure imparts a smooth uniform contact area for contact by the dryer 60.

As illustrated, the bearing 40 includes a lower band portion 50 also referred to as a wiper of felted material such as wool or the like extending away from either end of the load bearing portion 42 for disposition in surrounding relation to the drum support flange 34. As shown, the lower band portion has a width such that it may be folded upon itself during installation thereby forming a seal at the forward edge of the drum 60. As illustrated in FIG. 3, the ends of the lower band portion 50 may be adhered to the load bearing portion by the application of seams 52 such as sewn seams or the like between the lower band portion and an extended lip portion 54 of the load bearing portion 42. A substantially stable ring-like structure is thereby formed.

It is, of course, to be understood that while exemplary embodiments have been illustrated and described, in no event is the invention to be limited to such illustrated and described embodiments since modifications may be made and other embodiments of the principles of this invention will no doubt occur to those of skill in the art. Therefore, it is contemplated that the invention shall extend to all such modifications and other embodiments as may fall within the true spirit and scope of this invention.

What is claimed is:

1. A bearing assembly for rotatably supporting an end of a rotatable dryer drum located within a dryer cabinet, the bearing assembly comprising:

a load bearing member adapted for disposition in underlying supporting relation to a portion of the dryer drum, wherein the load bearing member comprises a surface layer comprising wool fibers secured in substantially stable relation to at least one underlying layer of load bearing felted material and wherein the surface layer and the load bearing felted material are needled to one another such that a portion of the fibers from the surface layer are entangled with fibers within the load bearing felted material to yield a load bearing composite structure.

2. The bearing assembly as recited in claim 1, wherein the surface layer comprises a blend of wool fibers and synthetic fibers.

3. The bearing assembly as recited in claim 1, wherein the load bearing felted material comprises needled polyester fibers.

4. The bearing assembly as recited in claim 3, wherein load bearing felted material further comprises a heat activatable constituent having a melting point less than the needled polyester fibers such that upon application of heat the heat activatable constituent undergoes preferential melting such that upon cooling the polyester fibers are adhesively bonded in a matrix of the heat activatable constituent.

5. The bearing assembly as recited in claim 4, wherein the heat activatable constituent comprises low melting point polyester.

6. The bearing assembly as recited in claim 1, wherein the load bearing felted material is a needle punched felted material formed from fibers selected from the group consisting of polyester polypropylene, polyamide, acrylic, aramid and blends thereof.

7. A bearing assembly for rotatably supporting an end of a rotatable dryer drum located within a dryer cabinet, the bearing assembly comprising:

a load bearing member adapted for disposition in underlying supporting relation to a portion of the dryer drum, wherein the load bearing member comprises a surface layer comprising wool fibers defining a surface for contacting the dryer drum and wherein the surface layer is secured in substantially stable relation to a first side of at least one layer of load bearing felted material and wherein a containment layer of fibrous material is secured in substantially stable relation across a second side of said at least one layer of load bearing felted material such that said at least one layer of load bearing felted material is disposed in sandwiched relation between the surface layer and the containment layer and wherein the surface layer and the containment layer are needled to said at least one layer of load bearing felted material such that a portion of the fibers from the surface layer and a portion of the fibers from the containment layer are entangled with fibers within the load bearing felted material to yield a load bearing composite structure.

8. The bearing assembly as recited in claim 7, wherein the surface layer comprises a blend of wool fibers and synthetic fibers.

9. The bearing assembly as recited in claim 7, wherein the load bearing felted material comprises needled polyester fibers.

10. The bearing assembly as recited in claim 9, wherein load bearing felted material further comprises a heat activatable constituent having a melting point less than the needled polyester fibers such that upon application of heat the heat activatable constituent undergoes preferential melting such that upon cooling the polyester fibers are adhesively bonded in a matrix of the heat activatable constituent.

11. The bearing assembly as recited in claim 10, wherein the heat activatable constituent comprises low melting point polyester.

12. The bearing assembly as recited in claim 7, wherein the load bearing felted material is a needle punched felted material formed from fibers selected from the group consisting of polyester polypropylene, polyamide, acrylic, aramid and blends thereof.

13. The bearing assembly as recited in claim 7, wherein the containment layer is wool.

* * * * *